US009731317B2

(12) United States Patent
Stevens

(10) Patent No.: US 9,731,317 B2
(45) Date of Patent: Aug. 15, 2017

(54) DEVICE FOR HOLDING AND DISPENSING VISCOUS MATERIAL

(71) Applicant: Sonoco Development, Inc., Hartsville, SC (US)

(72) Inventor: James P Stevens, Ford Mill, SC (US)

(73) Assignee: Sonoco Development, Inc., Hartsville, SC (US)

( * ) Notice: Subject to any disclaimer, the term of this patent is extended or adjusted under 35 U.S.C. 154(b) by 242 days.

(21) Appl. No.: 14/591,252

(22) Filed: Jan. 7, 2015

(65) Prior Publication Data

US 2016/0107190 A1 Apr. 21, 2016

Related U.S. Application Data

(60) Provisional application No. 62/064,127, filed on Oct. 15, 2014.

(51) Int. Cl.

| | |
|---|---|
| ***B65D 88/54*** | (2006.01) |
| ***B05C 17/005*** | (2006.01) |
| ***B05C 17/01*** | (2006.01) |
| ***B65D 83/00*** | (2006.01) |

(52) U.S. Cl.

CPC .... *B05C 17/00596* (2013.01); *B05C 17/0116* (2013.01); *B05C 17/0123* (2013.01); *B65D 83/0005* (2013.01); *B05C 17/0052* (2013.01); *B05C 17/00516* (2013.01)

(58) Field of Classification Search

CPC ..... B05C 17/00503; B05C 17/00506; B05C 17/0052; B05C 17/00576; B05C 17/00596; B05C 17/00516; B05C 17/01; B05C 17/015; B65D 83/0005

See application file for complete search history.

(56) References Cited

U.S. PATENT DOCUMENTS

| | | | | |
|---|---|---|---|---|
| 336,811 A | | 2/1886 | Jones | |
| 1,318,928 A | * | 10/1919 | Shields | B05C 17/01 206/384 |
| 2,065,603 A | | 12/1936 | Miller | |
| 2,090,111 A | | 8/1937 | Creveling | |

(Continued)

FOREIGN PATENT DOCUMENTS

| | | |
|---|---|---|
| JP | 1085645 | 4/1989 |
| WO | 2004106217 A1 | 12/2004 |
| WO | 2005077813 A1 | 8/2005 |

OTHER PUBLICATIONS

Partial PCT search report for application PCT/US2015/055231, file Oct. 13, 2015.

*Primary Examiner* — Patrick M Buechner

(74) *Attorney, Agent, or Firm* — Flaster/Greenberg P.C.

(57) ABSTRACT

A dispensing device is provided for storing and dispensing a flowable, viscous material. A cartridge is provided for storing the material and includes a tube, a movable cup member located within the tube, an end wall having a nozzle opening covered with a removable seal and a nozzle. The nozzle is removably held within the cup member during storage. The dispensing device is formed by inserting the cartridge within the actuator. The actuator comprises a barrel, a trigger, a handle, a plunger and a resilient detent. The movement of the trigger causes the plunger to push the moveable member forward. The detent holds the plunger in place maintaining the flow of material.

7 Claims, 11 Drawing Sheets

(56) References Cited

U.S. PATENT DOCUMENTS

| | | | |
|---|---|---|---|
| 2,106,577 | A | 1/1938 | Sherbondy |
| 2,421,711 | A | 6/1947 | Moots et al. |
| 2,441,649 | A | 5/1948 | Sprague |
| 2,478,078 | A | 8/1949 | Battenfeld |
| 2,543,909 | A | 3/1951 | Hatheway, Jr. |
| 2,547,871 | A | 3/1951 | Kirk |
| 2,587,683 | A | 3/1952 | Barry |
| 2,642,906 | A | 7/1953 | Jones et al. |
| 2,687,831 | A | 8/1954 | Miller |
| 2,727,659 | A | 12/1955 | Nyden |
| 2,754,033 | A | 7/1956 | Etter |
| 2,792,976 | A | 5/1957 | Stewart |
| 2,821,332 | A | 1/1958 | Sherbondy |
| 2,833,450 | A | 5/1958 | Sherbondy |
| 2,836,333 | A | 5/1958 | Woodel |
| 2,842,289 | A | 7/1958 | Malpas |
| 2,911,128 | A | 11/1959 | Krautkramer |
| 2,981,448 | A | 4/1961 | Anderson |
| 2,981,449 | A | 4/1961 | Perkins |
| 2,981,450 | A | 4/1961 | Anderson |
| 3,029,987 | A | 4/1962 | Gronemeyer |
| 3,071,294 | A | 1/1963 | Galbierz |
| 3,093,274 | A | 6/1963 | Galbierz |
| 3,156,367 | A | 11/1964 | Harwood |
| 3,189,226 | A | 6/1965 | Sherbondy |
| 3,266,682 | A | 8/1966 | Schultz |
| 3,527,389 | A | 9/1970 | Farmer |
| 3,672,547 | A | 6/1972 | Kozlowski |
| 3,884,396 | A | 5/1975 | Gordon et al. |
| 3,964,641 | A | 6/1976 | Langensiepen et al. |
| 4,081,112 | A | 3/1978 | Chang |
| 4,342,408 | A | 8/1982 | Boring et al. |
| 4,356,938 | A | 11/1982 | Kayser |
| 4,432,473 | A | 2/1984 | MacEwen |
| 4,461,407 | A | 7/1984 | Finnegan |
| 4,595,129 | A | 6/1986 | Okuno et al. |
| 4,655,372 | A | 4/1987 | Ross et al. |
| 4,826,049 | A | 5/1989 | Speer |
| 4,830,231 | A | 5/1989 | Smith |
| D316,019 | S | 4/1991 | Belanger |
| 5,082,147 | A | 1/1992 | Jacobs |
| 5,137,184 | A | 8/1992 | Jackson et al. |
| 5,249,716 | A | 10/1993 | O'Sullivan |
| 5,335,827 | A | 8/1994 | Gentile |
| 5,431,654 | A | 7/1995 | Nic |
| D370,396 | S | 6/1996 | Belanger et al. |
| 5,615,807 | A | 4/1997 | Peng |
| D386,954 | S | 12/1997 | Melendy et al. |
| 5,788,126 | A | 8/1998 | Chang |
| 5,875,920 | A | 3/1999 | Parent |
| 5,915,594 | A | 6/1999 | Nakata |
| 6,022,504 | A | 2/2000 | Boaz et al. |
| D469,670 | S | 2/2003 | Belanger |
| D474,949 | S | 5/2003 | Schaffeld et al. |
| 6,672,489 | B1 | 1/2004 | Huang |
| 6,691,899 | B2 | 2/2004 | Sung |
| 6,820,768 | B2 | 11/2004 | Belanger |
| D514,408 | S | 2/2006 | Melendy et al. |
| D517,880 | S | 3/2006 | Melendy et al. |
| 7,014,079 | B2 | 3/2006 | Swann |
| 7,445,135 | B2 | 11/2008 | Miyata et al. |
| D590,674 | S | 4/2009 | Belanger |
| 7,631,790 | B2 | 12/2009 | Braams |
| 7,757,904 | B2 | 7/2010 | Rumrill et al. |
| 8,342,371 | B2 | 1/2013 | Helmenstein |
| 8,365,953 | B2 | 2/2013 | Calvo et al. |
| 8,419,401 | B2 | 4/2013 | McMahon et al. |
| 8,650,736 | B2 | 2/2014 | Robertson et al. |
| 2002/0162859 | A1 | 11/2002 | Summons et al. |
| 2003/0089736 | A1 | 5/2003 | Ichikawa et al. |
| 2005/0005379 | A1* | 1/2005 | Chang ..... B05C 17/01 15/105 |
| 2007/0119865 | A1 | 5/2007 | Belanger et al. |
| 2008/0156831 | A1 | 7/2008 | Nakayama et al. |
| 2008/0245823 | A1 | 10/2008 | de Oliveira et al. |
| 2009/0114684 | A1* | 5/2009 | Helmenstein ..... B05C 17/005 222/538 |
| 2009/0194567 | A1* | 8/2009 | Helmenstein ..... B05C 17/00516 222/521 |
| 2011/0089192 | A1 | 4/2011 | McMahon et al. |
| 2011/0174836 | A1* | 7/2011 | Summons ..... B05C 17/003 222/129 |
| 2011/0272436 | A1 | 11/2011 | Vogt et al. |
| 2013/0214013 | A1* | 8/2013 | Milan ..... B05C 17/00506 222/538 |
| 2014/0008397 | A1 | 1/2014 | Edamatsu et al. |
| 2014/0144929 | A1 | 5/2014 | Fitzmeyer et al. |
| 2015/0021359 | A1 | 1/2015 | Belanger et al. |

* cited by examiner

DEVICE FOR HOLDING AND DISPENSING VISCOUS MATERIAL

CROSS REFERENCE TO RELATED APPLICATION

The present disclosure claims priority to and the benefit of the filing date of U.S. Provisional Application No. 62/064,127, filed Oct. 15, 2014.

FIELD OF THE INVENTION

The present disclosure relates to a dispensing device having a cartridge for holding viscous material and an actuator for dispensing the material from the cartridge.

BACKGROUND

The use of a cartridge for storing a viscous material is known. Such cartridges are often configured to be used with an actuator for directing the dispensing from the cartridge. The known cartridges are often formed by a cylindrical tube having a substantially rigid outer shell and a nozzle at one end. A moveable piece or plunger cup is located within the end opposite of the nozzle. The plunger cup is pushed towards the nozzle within the tube by the actuator to force the material from within the cartridge through the nozzle.

U.S. Pat. No. 4,342,408 to Boring discloses a caulk cartridge having a separate nozzle member that seals with the end wall of the cartridge tube. The nozzle includes an enlarged annular base that engages with the inside surface of the end wall, when positioned within an opening in the end wall. The pressure from the caulk material forces the base of the nozzle into engagement with the end wall to seal the opening. Caulk is directed through the nozzle.

U.S. Pat. No. 2,587,683 to Barry discloses a disposable caulking gun. The gun is formed by a tubular container that is adapted to carry an ejection key and a nozzle prior to use. The ejection key is threaded into the back of the container and is used to drive an internal plunger to expel the material through the nozzle attached to the opposite end of the container.

U.S. Pat. No. 5,137,184 to Jackson et al. discloses a disposable cartridge that is inserted within a caulking gun for dispensing the stored material through a removable nozzle. The nozzle is fixed to the cartridge during positioning of the nozzle and cartridge within the gun structures.

Typical actuators for directing the dispensing of material from a cartridge include a front portion that engages the front end of the cartridge and a plunger is located at the rear of the actuator. The plunger is incrementally moved towards the front end of the actuator and pushes the plunger cup within the cartridge towards the front of the cartridge. The movement of the cup forces the material stored within the cartridge through the nozzle at the opposite end.

Often the actuator resembles the shape of a gun, with a base portion formed to retain the cartridge, a holding handle and a trigger extending below the base for actuating movement of the plunger. Numerous variations of the interaction between the trigger and the plunger are known. Generally, a rod with teeth is provided for supporting the plunger. A ratcheting mechanism engages the rod teeth with the trigger creating the incremental movement of the plunger.

U.S. Pat. No. 4,356,938 to Kayser discloses a caulking gun having a pressure release mechanism. The release of the pressure stops the flow of caulk from the cartridge.

U.S. Pat. No. 5,875,920 to Parent discloses a caulking gun that is reduced in length and accepts a cartridge with a tube length of approximately one half the length of a conventional caulk tube.

U.S. Pat. No. 6,672,489 to Huang discloses a caulking gun with a ratchet push rod. The ratchet mechanism allows the push rod to move backward after the trigger moves it forward. The backward movement reduces pressure in the tube to prevent excess discharge of the stored material at the end of the actuated movement.

SUMMARY OF THE INVENTION

A cartridge for storing a flowable, viscous material is provided. Also provided is a dispensing device for directing the dispensing of the material from the cartridge.

In one aspect of the disclosure, a cartridge is formed as a hollow tube having a first end with a top or end wall closure at one end and a second end forming a rear opening. The top closure includes a nozzle opening, which is normally covered by a seal. The cartridge also includes a cup member positioned within the hollow of the tube that is longitudinally movable within the tube. The cup member is initially located towards the second end of the tube and seals the material within the tube. The cup member has a bottom wall and one or more sidewalls. The sidewalls extend from the bottom to create the cup shape with the open end of the cup facing towards the second opening of the tube. The length of the nozzle is substantially equivalent to the inside diameter or transverse dimension of the cup member. During shipment and storage of the cartridge, a nozzle member is removably secured within the sidewalls of the cup member. The nozzle may be removed from the cup member at the time of intended use. The nozzle is positioned within the nozzle opening of the end wall after removal of the seal. In a preferred form the cartridge is sized to hold an amount of material that is typical for a single use application. Further, the cartridge or the dispensing device may be disposed after a use.

In a further aspect of the cartridge, the nozzle may include a cartridge engagement portion at one end. The engagement portion is preferably sized and shaped to be inserted into the nozzle opening in the top of the cartridge and to be secured to the rim of the opening. The nozzle may also be secured within the sidewalls of the cup member using a friction fit during storage. A removable seal may be provided to cover the second opening and to retain the nozzle within the cup member.

In a further aspect of the disclosure, an actuator is defined for use with a cartridge for storing a flowable, viscous material. The actuator includes a barrel configured to hold the cartridge, a handle extending from the barrel and a plunger formed by a rod and a disc. The cartridge is located within the barrel and the disc placed in contact with the cup member. The rod, including at least one plurality of teeth along its length. A trigger is pivotably connected to the handle and is movable between a first position and a second position. The trigger includes at least one tooth that engages the first plurality of teeth when the trigger is in the first position. A detent having a projected leg associates with a first tooth on the rod and fixes the rod, preventing a reversal movement during use. The movement of the trigger from a first position to a second position causes the at least one tooth to move forward, moving the plunger rod and the disk. In turn, the cup member of the cartridge moves forward towards the nozzle, forcing the material from the cartridge, through the nozzle. The movement of the trigger also moves the rod, resulting in the first tooth moving away from the second leg of the detent to an engagement position on a second tooth. Preferably, a first plurality of teeth is formed on one side of the rod and a second plurality of teeth is located on opposite side of the rod, with the trigger engagement of the first set of teeth and the detent engaging the second set of teeth.

In a further aspect of the disclosure, a dispensing device is provided and includes the combination of a cartridge and an actuator. In a preferred version of the dispensing device, the cartridge is formed as described above and the actuator is also preferably formed as described.

The chamber of the cartridge may have a preferred volume of about 4 ounces, or what has been determined to closely represent sufficient material for a single consumer household project. This storage volume may be defined by a tube having an overall length of about 5.625 inches with an internal diameter of about 1.4 inches. The final position of the cup member within the tube may be varied to set the volume of material stored within the tube. Further, the entire dispensing device may be made of inexpensive materials so as to be disposable after use.

Other features of the cartridge, the actuator and the dispensing device combination will become apparent from the detailed description to follow, taken in conjunction with the accompanying drawings.

BRIEF DESCRIPTION OF THE DRAWINGS

For the purpose of illustrating the invention, there is shown in the drawings one or more forms that are presently preferred; it being understood that the invention is not limited to the precise arrangements and instrumentalities shown.

DETAILED DESCRIPTION

Figure 1:
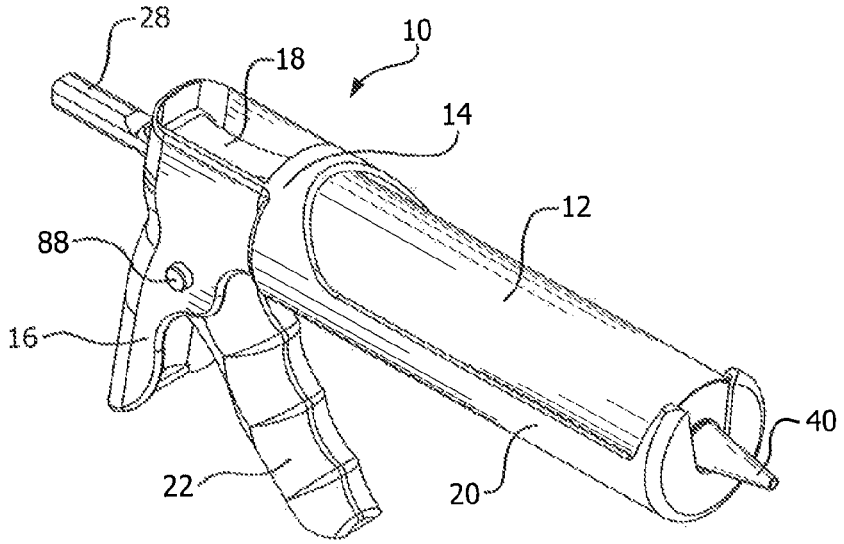
FIG. 1 is a perspective view of an embodiment of a dispensing device as contemplated by the present disclosure, wherein a cartridge is positioned within an actuator.
Figure 2:
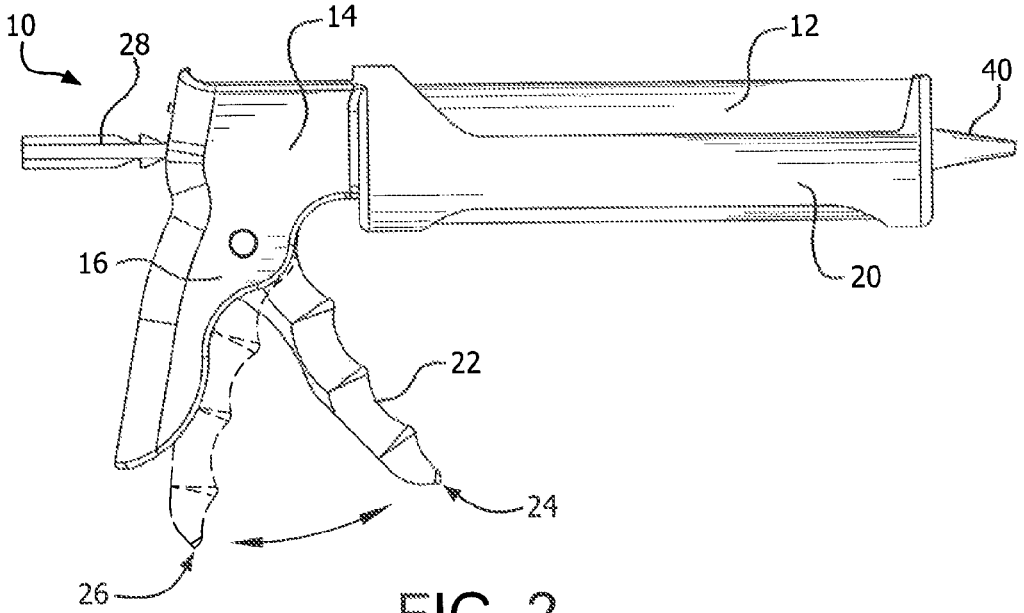
FIG. 2 is a side elevation view of the dispensing device of FIG. 1 showing the movement of a trigger from a first position to a second position.

In the figures, where like numerals identify like elements, there is shown an embodiment of a dispensing device. In FIG. 1 the dispensing device is generally designated by the numeral 10 and includes the combination of a cartridge 12 and an actuator 14. The cartridge 12 is inserted into a barrel 20 within the actuator 14. A trigger 22 extends from the barrel 20 adjacent a handle 16. As shown in FIG. 2 the trigger may be moved from a first position 24 to a second position 26. Movement of the trigger directs a plunger portion of the actuator (discussed below), forcing the material from within the cartridge 12 out through a nozzle 40 positioned at one end of the cartridge 12.

Figure 3:
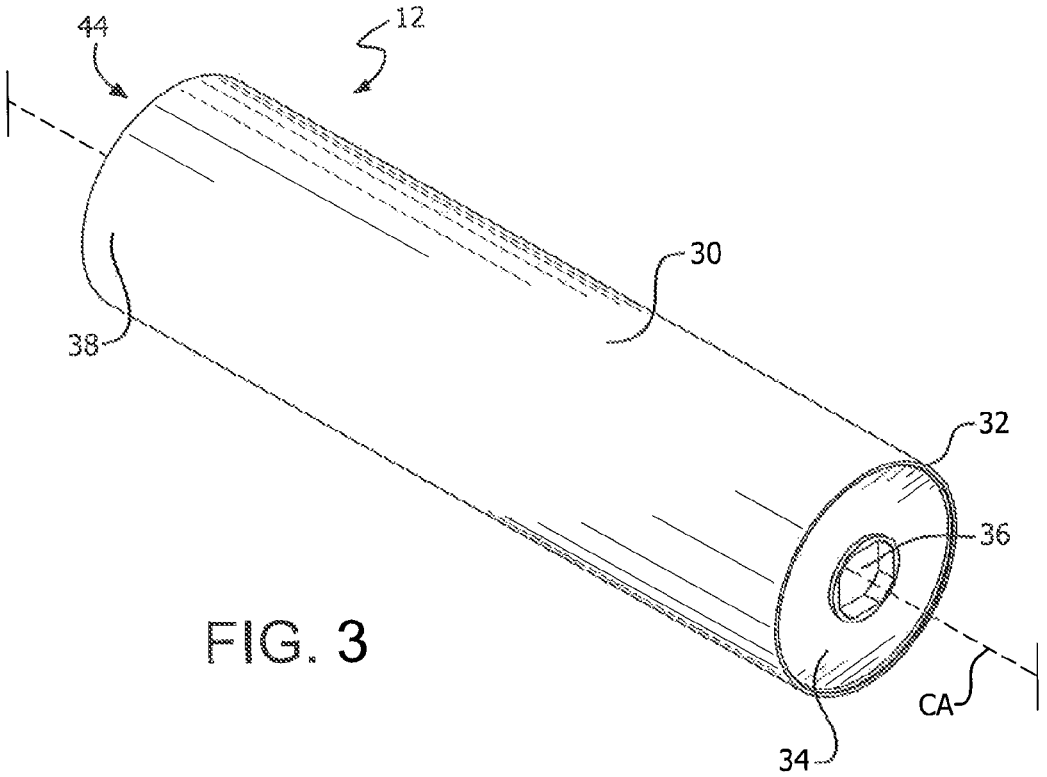
FIG. 3 is a perspective view of the cartridge shown in FIG. 1, showing a top or first end.
Figure 4:
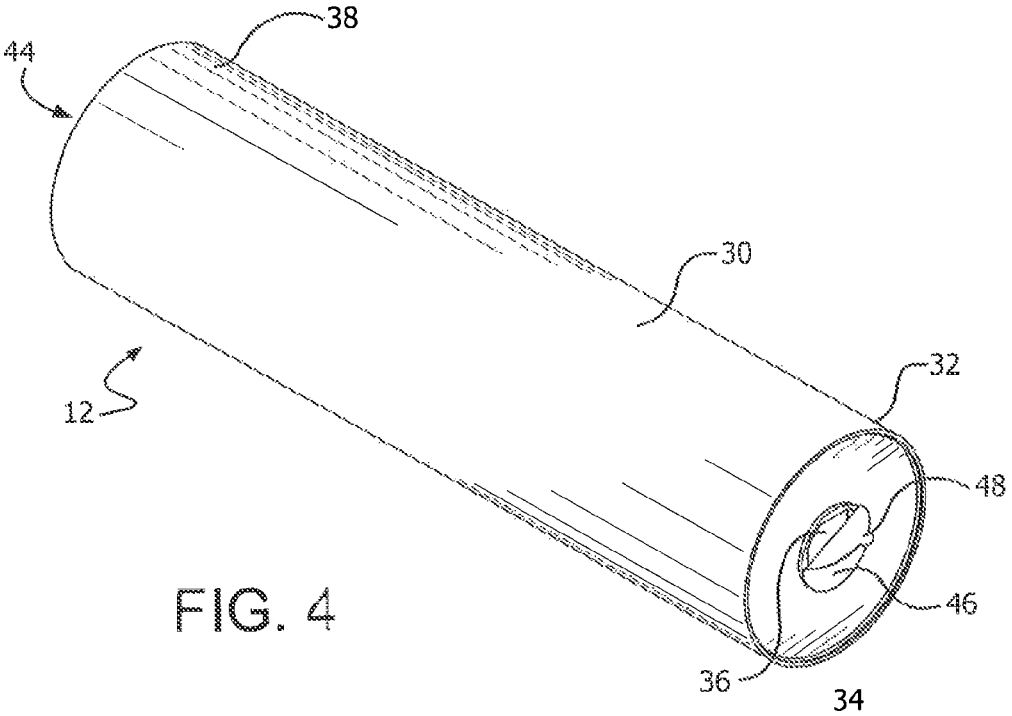
FIG. 4 is a perspective view of the cartridge showing a removable seal.
Figure 5:
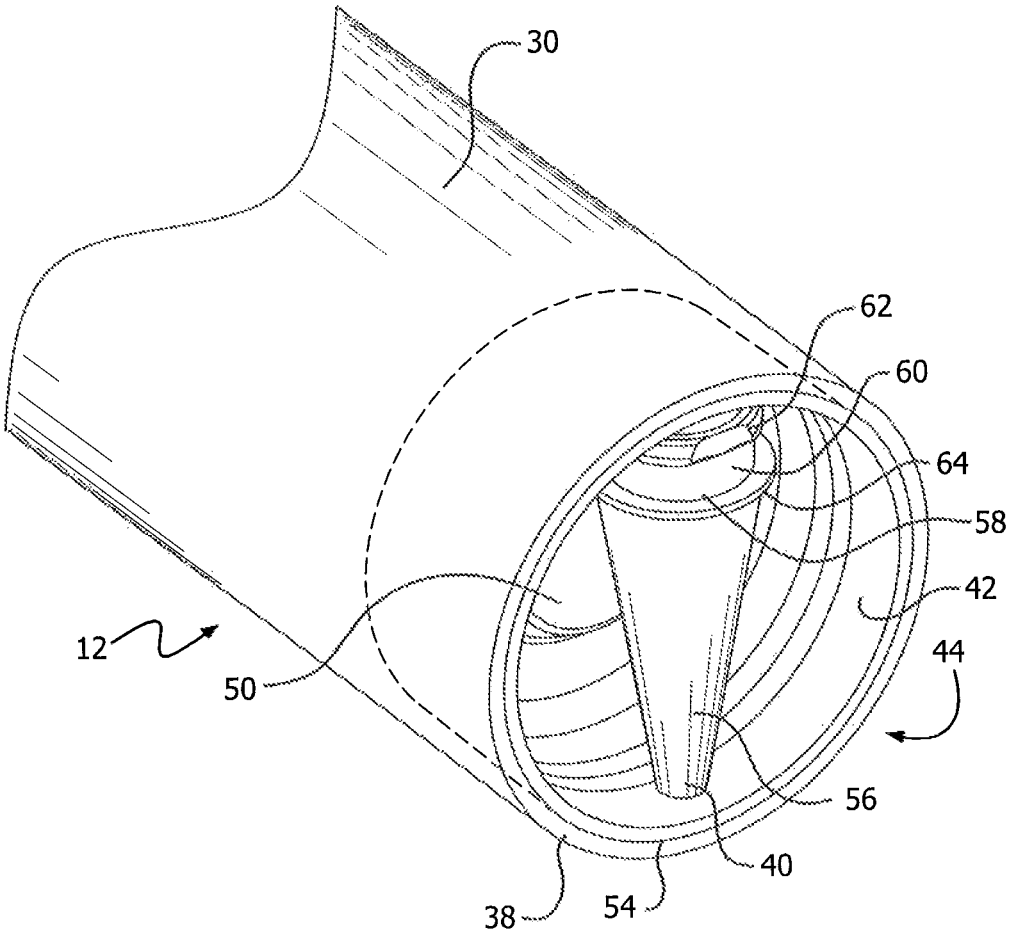
FIG. 5 is a perspective partial view of a second end of the cartridge, showing a nozzle in a storage position.

FIGS. 3-5 show the structure of the cartridge 12 including a hollow tube 30 having a first or top end 32 and a top or end wall 34. A nozzle opening 36 is provided in the end wall 34. In FIG. 4, the nozzle opening 36 in the top 34 is covered by a removable seal 46. In FIG. 5, a second or rear end 38 of the tube 30 is shown. The rear end 38 defines a second or rear opening 44 into the interior of the tube 30. A movable cup member 42 is positioned within the tube 30 to seal the second end 38. As shown, a nozzle 40 is removably stored within the interior of the cup member 42.

The tube 30 preferably has an elongated cylindrical shape. Other shapes are contemplated, so long as the tube is capable of holding a flowable, viscous material and is capable of being inserted into an actuator such that the material can be dispensed using the actuator. The end wall 34 closes the first end 32 of the tube 30. The nozzle opening 36 is preferably located in the center of the end wall 34 and is formed about the central longitudinal axis CA of the cartridge 12. As shown, the shape of the outer edge of the nozzle opening 36 is hexagonal for receipt of a similarly shaped end 58 on the nozzle 40. The hexagon shape acts as a key for easy insertion of the nozzle end 58 (see FIG. 5) into the opening, with a small rotation creating a locking of the nozzle 40 to the wall 34. Any shape may be provided, including circular, triangular, rectangular, octagonal, etc. In one possible variation, the nozzle end 58 may include or more teeth or formed channel, with the inside surface of the nozzle opening including a corresponding engagement structure, In this configuration (not shown), the corresponding structures are engaged as a nozzle is inserted into a nozzle opening. Once in place, the nozzle may be rotated so that the engagement fixes or locks the nozzle in place to deter or prevent accidental removal of the nozzle from the nozzle opening.

The removable seal 46 covers the nozzle opening 36. An internal seal (not shown) may also be provided and may be accessible through the opening 36. The removable seal 46 is secured to the top 34, such as by an adhesive that is sufficiently strong to hold the contents within the cartridge 12, during transport and storage, and is peelable by manual force. The removable seal 46 includes a pull tab 48 for easier grasping and removal. The nozzle opening 36 may be closed or covered in any fashion that retains the material within the cartridge 12 during shipment and seals the material from the external environment.

The cup member 42 is formed by a bottom wall 50 and a sidewall 52. Since the tube 30 shown is cylindrical in shape, the sidewall 52 is also shown as being cylindrical. The cup member 42 is positioned within the second end 38 of the tube 30. The outer surface 54 of the cup member 42 contacts and forms a seal with the inside wall of the tube 30. The tolerances are relatively close, with the cup member 42 being movable within the tube 30, while maintaining a seal sufficient to hinder the flow of stored material between the tube wall and the outer sidewall surface 54. Various shapes and forms for the outer surface 54 of the sidewall 52 are known for creating the desired level of seal during movement of the cup member 42.

As shown in FIG. 5, the nozzle 40 includes a tip 56 and an engagement end 58. The tip 56 is preferably tapered for directing material during dispensing. The preferable shape for the tip 56 is conical or frustoconical, with a circular transverse cross section. Various shapes for the tip 56 of the nozzle are possible, including oval, elliptical, plus-shaped, cross-shaped, star-shaped, etc. The relatively larger diameter portion of the nozzle tip 56 is positioned closest to the engagement end 58. The tip 56 of the nozzle 40 is open to create an outlet for the passageway through the nozzle body. Because the nozzle is separate from the cartridge body, the open tip 56 may be provided and there is no need for tools to assemble and cut open the nozzle. A membrane seal (not shown) may be provided on the outside of the nozzle tip 56. The membrane can be peeled off by the consumer to open the nozzle. Hence, there is no need for tools to assemble and dispense the material. This combination eliminates the need for a knife to cut a nozzle, or a nail or similar tool to reach down inside a fixed nozzle and puncture the foil patch (if present) at the base of the nozzle. Of course, there is always the ability to re-size the nozzle if need be with a knife. Alternatively, the narrow end of the nozzle tip 56 may be provided in a closed condition and then cut to open the passageway through the nozzle 40.

At least a portion of the engagement end 58 of the nozzle 40 includes a hexagonal external perimeter, which is complementary to the inside surface of the nozzle opening 36 on the end wall 34 of the tube 30. The nozzle engagement end 58 includes a first section 60, a second section 62 and a shoulder 64. The first section 60 includes an outer dimension that is less than the dimension of the second section 62 and shoulder 64. The first section is located between the second section 62 and the shoulder 64. The outer dimension of the second section 62 of the nozzle engagement end 58 closely corresponds to the dimensions of the nozzle opening 36, having a similar or complimentary shape. The second section 62 is positioned adjacent the end and is inserted into and through the nozzle opening 36. Once the second section 62 is inward of the end wall 34, the first section is located adjacent the opening 36 and the shoulder 64 engages the outside rim of the opening 36. The nozzle 40 is then rotated such that the second section 62 locks on inside surface of the end wall 34 and the shoulder 64 fixes the nozzle 40 with respect to the rim of the nozzle opening 36. Preferably, the dimensions are such that a frictional engagement is maintained. It is also preferable that the nozzle 40 not rotate or otherwise release, potentially resulting in an ejection of the nozzle from the end 32 of the tube 30. Again, other shapes and formations, such as a bayonet type fixing structure are possible. An elastically deformable material may also be utilized. Further, the engagement end 58 of the nozzle 40 may include a piercing member (not shown) for opening an internal seal (not shown) on the inside or other surface adjacent the nozzle opening.

The second section 62 and the shoulder 64 of the nozzle engagement end 58 have larger outer diameters than the first diameter section 60. The diameter of the second diameter section 62 is sized such that it may be inserted through the nozzle opening 36. Preferably, the second diameter section 62 is made from an elastically material sufficiently deformable so that it can be inserted through the nozzle opening 36 to provide a press fit seal within the tube 30. Alternatively the second section 62 fits within the opening 36 and may be rotated to lock the nozzle 40 in place. The shoulder 64 is located between the engagement end 58 and the tip 56 of the nozzle 40. The diameter of the shoulder is sufficiently large to prevent the nozzle 40 from being inserted further than desired.

The length of the nozzle 40 is shown to be similar to the inside diameter or transverse dimension of the sidewall 52 of the moveable member 42. As shown in FIG. 5, prior to use, the nozzle 40 is stored within the moveable member 42. In the stored position, the tip 56 of the nozzle 40 and the second section 62 may contact or otherwise engage the inside surfaces of the sidewall 52 of the cup member 42. For example, the nozzle 40 may be secured within the member 42 by a friction fit.

Figure 5A:
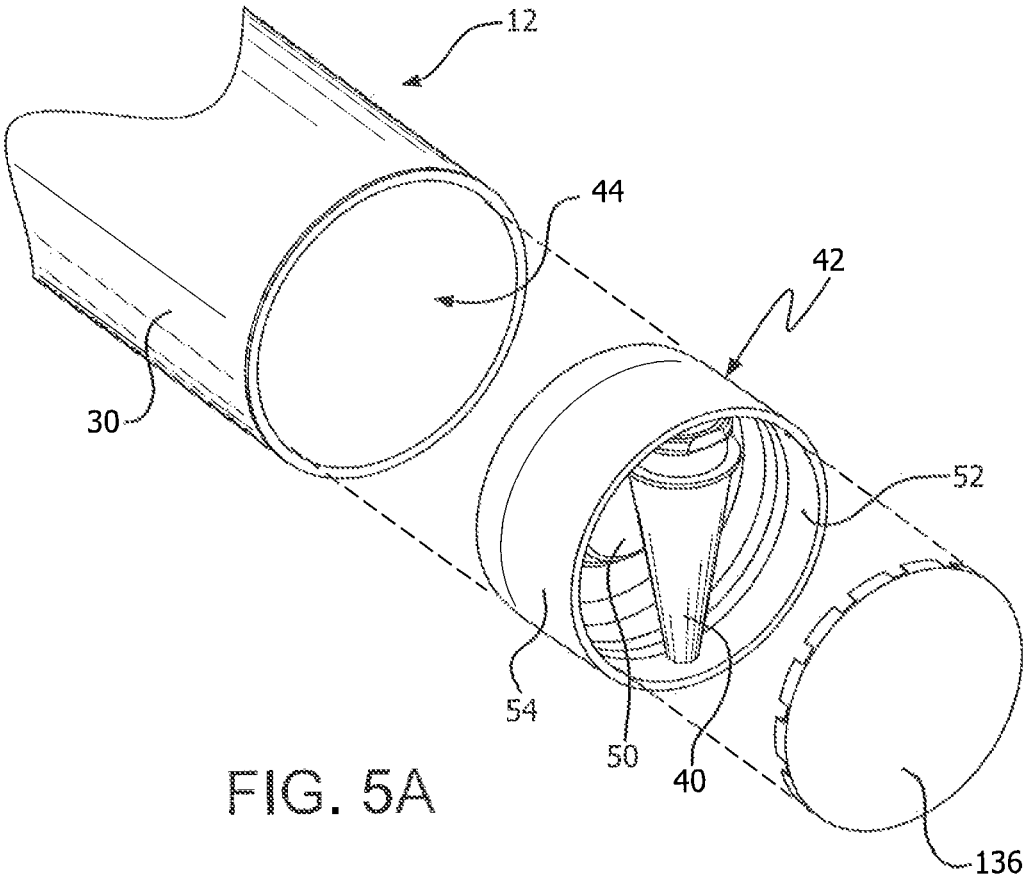
FIG. 5A is an exploded perspective view of a second end of the cartridge, showing a nozzle in a storage position.
Figure 5B:
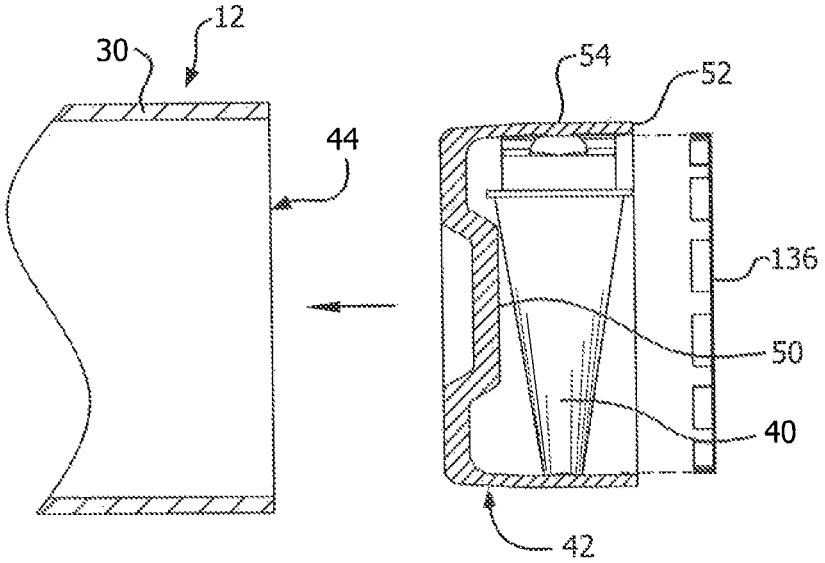
FIG. 5B is a cross-section view of the exploded second end of the cartridge, also showing the nozzle in a storage position.

As shown in FIGS. 5A and 5B, a lid 136 is provided to close the open end of member 42 to further secure the nozzle 40. The lid 136 is removably inserted into the opening of the cup-shape of the member 42 and is secured by a friction fit. Alternatively, the lid member 36 may be secured over the outside of the wall of the tube 30 of the cartridge 12, or may engage within the inside surface of the tube 30, adjacent the cup 42. An additional seal (not shown) may be provided to affix the edges of the lid 136 to the cup 42 or tube 30, such as a releasable adhesive.

As shown in FIG. 5B, the nozzle 40 extends along the diameter of the cup member 42. Other nozzle positions (not shown) are possible, including the nozzle being held diagonally with the tip positioned relatively closer to the edge of the opening and the second engagement end positioned closer to the bottom wall 50 of the moveable member 42. Diagonally positioning the nozzle allows the nozzle length to be slightly longer than the diameter of the cup member 42. Again, other methods of securing the nozzle 40 within the cup member 42 are also possible, including the use of an adhesive, elastically deformable materials, a removable seal over the second opening, integral molding of the parts, etc.

The tube 30, the cup member 42, the end wall 34 and the seal 46 define the chamber for storing the flowable material. The volume of the chamber may be sized as desired. Preferably, the amount of material stored is appropriate for a single consumer household project. Larger or smaller volumes are also possible. One preferred volume of the chamber is approximately 4 ounces. A length for the tube 30 may be about 5.625 inches with an internal diameter of about 1.44 inches. The tube 30 is the preferably cylindrical and relatively longer than it is wide. The cartridge is preferably injection molded from plastic materials. The tube 30 may be a plastic extrusion or formed from a composite material, with the end wall attached thereto. The end wall may be made of metal, plastic, composites, etc. Any material may be used and the materials are preferably sufficiently inexpensive to economically allow the cartridge to be disposable after use.

When the user desires to dispense the material stored within the cartridge 12, the nozzle 40 is removed from the cup member 42, the seal 46 is removed from the nozzle opening 36 and the engagement end 58 is inserted into the nozzle opening 36. Once the nozzle 40 is secured to the nozzle opening 36, the cartridge 12 is ready to be mounted in the actuator 14 to form the dispensing device 10.

Figure 6:
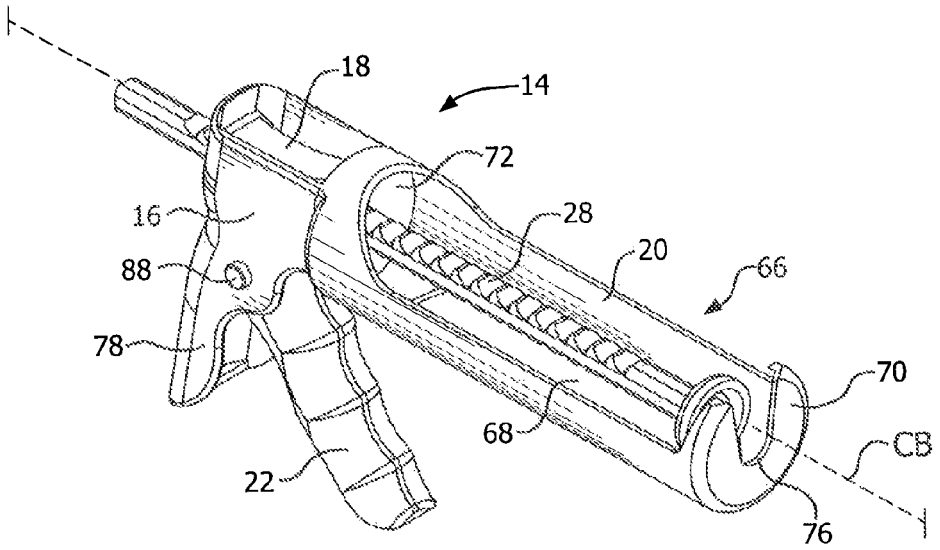
FIG. 6 is a perspective view of the actuator shown in FIG. 1.
Figure 7:
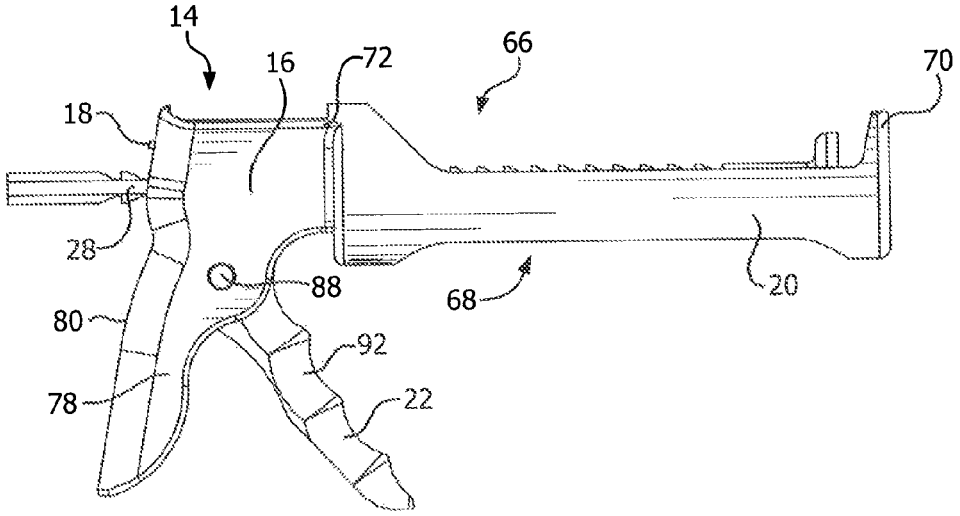
FIG. 7 is a side elevation view of the actuator of FIG. 6.

As shown in FIGS. 6-10, the actuator 14 is created by the combination of a barrel 20, a handle 16, a plunger 28, a trigger 22 and a detent 18. FIGS. 6 and 7 show the actuator 14 as fully assembled without a cartridge inserted therein. Preferably, all parts of the actuator 14 are molded from plastic material(s).

The barrel 20 is configured to hold the cartridge 12. The barrel 20 includes a cylindrical internal space for receiving the cylindrical tube 30 of the cartridge 12 and is sized such that the central longitudinal axis CA of the cartridge 12 aligns with the central longitudinal axis CB of the barrel 20. As shown, an upper opening 66 is provided so that the cartridge 12 may be inserted into the internal space of the barrel 20. A lower opening 68 may also be provided to reduce the cost and weight of the device and to provide visible access to the cartridge 12. The handle 16 is preferably integrally formed with the barrel 20 and projects from one end thereof. The barrel 20 includes a back 72 and a front 70. The back 72 includes a back axial opening 74 formed about the central longitudinal axis CB. The front 70 includes a nozzle slot 76 having a U-shape for receipt of the nozzle 40. The nozzle may rest in the nozzle slot 76. Preferably, the width across the bottom of the nozzle slot 76 is slightly larger than the largest outer diameter of the nozzle 40 so that when the plunger 28 is pushed forward, the edges of the nozzle slot 76 provide a retaining force on the tube 30. The length of the barrel 20 positions the end wall 34 of the tube 30 in contact with the front wall 70 of the barrel 20 and the rear end 38 of the tube 30 is spaced from the back wall 72 of the barrel 20.

Figure 8:
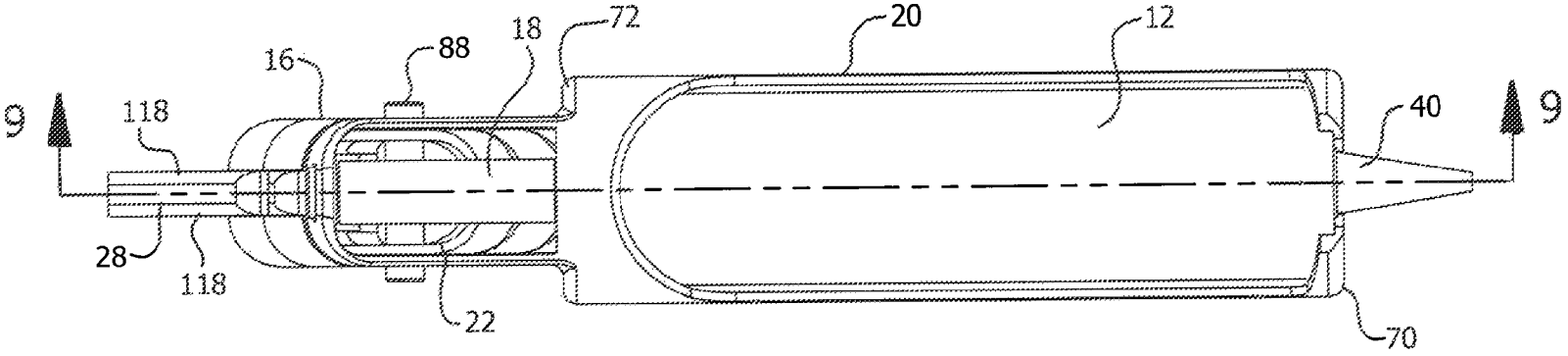
FIG. 8 is a top plan view of the dispensing device of FIG. 1.

The handle 16 is connected to the back wall 72 of the barrel 20 and includes a grasping region 78 located below the barrel 20. As seen in FIG. 8, when viewed from the top, the handle 16 has a U-shaped body, with the opening of the "U" facing to the front of the barrel. The backside 80 of the actuator 14 forms a detent slot 82 and a rod opening 84. The detent slot 82 is preferably centrally located along the barrel axis CB and is positioned above the rod opening 84. A detent 18 is secured within an open chamber within the backside 80 and is positioned behind the back 72 of the barrel 20. The rod opening 84 is centrally located on the axis CB of the barrel 20. The diameter of the rod opening 84 is large enough to allow a rod 102 to move freely along the longitudinal axis CB of the barrel 20. The rod opening 84 and rod 102 may have any desired shape that allows for movement along the longitudinal axis CB.

A handle opening 86 extends through the handle 16. A pin 88 is positioned in the opening 86 for securing the trigger 22 to the handle 16. The gripping element 92 includes a trigger opening 98 located towards the top. The trigger opening 98 corresponds in size with the handle opening 86, such that a pin 88 is inserted through the openings 86 and 98 to rotationally secure the trigger 22 to the handle 16. The width of the trigger 22 fits within the U-shape of the handle 16. The pin 88 allows the trigger 22 to rotate with respect to the handle 16 about the pin 88.

The trigger 22 includes a tooth extension 90 and a gripping element 92. A trigger stop 138 is located within the gripping element 92 and projects inwardly towards the handle 16. A handle stop 140 is formed at the base of the handle 16 and projects towards the gripping element 92 of the trigger 22. When the trigger 22 is moved towards the handle 16, the trigger stop 138 contacts the handle stop 140 to prevent further rotation of the trigger 22 about the pin 88.

Figure 9:
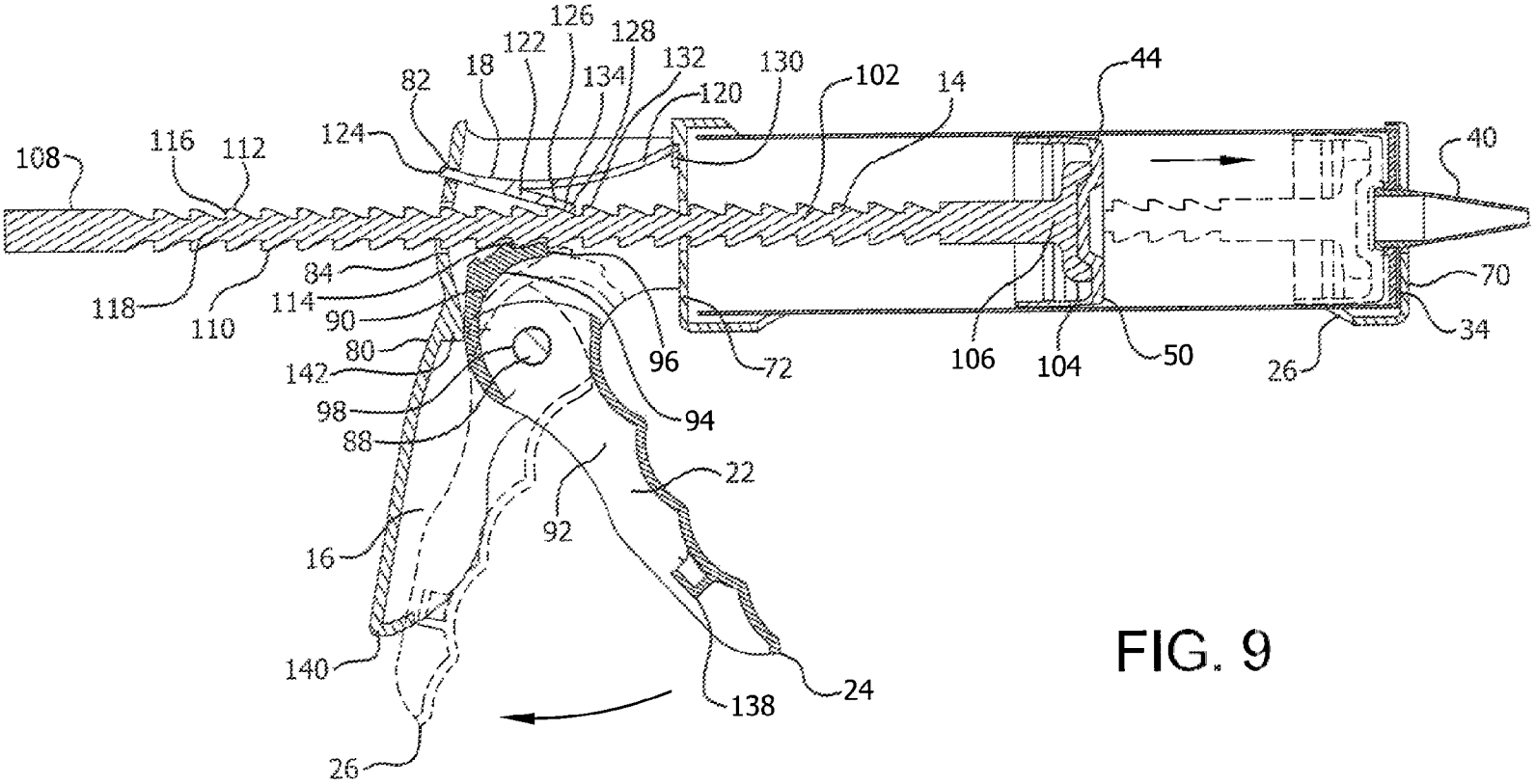
FIG. 9 is cross-section view of the dispensing device of FIG. 1 as taken along line G-G, in FIG. 8, showing movement of the trigger, plunger and moveable member from a first position to a second position within the cartridge.

The tooth extension 90 on the trigger 22 is located on the opposite side of the axis formed by the pin 22 and extends from the top of the trigger 22. The extension 90 includes at least one trigger tooth 94 or similar engagement structure. Three upward facing teeth 94 are shown in FIG. 9. Each trigger tooth 94 preferably has a triangular shape, with a vertical portion 96 of the tooth 94 facing towards the barrel 20. The tooth extension 90 forms a ratchet surface and is shown as being curved, about the axis of the pin 88. The trigger tooth 94 associates with and engages the first plurality of teeth 110 on the rod 102. Movement of the trigger 22 from the first position 24 to the second position 26 (see FIG. 2) moves the rod 102 along the central longitudinal axis CB of the barrel 20.

As shown in FIG. 9, in the first position 24 of the trigger 22, the trigger tooth 94 engages a plunger tooth 114 on the rod 102. The trigger 22 is rotatable to a second position 26, adjacent to the grasping region 78 of the handle 16. As the gripping portion 92 of the trigger 22 is retracted, the tooth extension 90 is rotated forward. During this rotation, the tooth 94 remains in engagement with the plunger tooth 114 on the rod 102, moving the rod 102 linearly along the axis CB. A spring mechanism (not shown) may be provided between the handle 16 and the trigger 22. The spring may be formed from an elastically deformable plastic or metal, such as a common coiled spring. The spring may be positioned between an opening in the back of the trigger and a bump 142 located on the handle 16 at the top of the grasping region 78. When the trigger 22 moves to the second position 26, the spring is deformed or compressed, providing a return force to return the trigger 22 back to the first position 24.

The plunger 28 is formed by the rod 102 and a disc 104. The rod 102 has a first end 106 and a second end 108. A first plurality of teeth 110 and a second plurality of teeth 112 are located along the length of the rod 102. The first plurality of teeth 110 is preferably on the opposite side of the rod 102 from the second plurality to teeth 112.

The disc 104 preferably fits within the opening of cup member 42, within the rear end 38 of the cartridge tube 30, and contacts the bottom 50 of the cup member 42 when the dispensing device 10 is assembled. The disk 104 is placed inside the barrel 20. The rod 102 extends through the back opening 74 of the barrel 20 and through the rod opening 84 in the backside 80 of the back of the handle 16. The rod 102 should be sufficiently long so that a part of the second end 108 of the rod 102 extends from the backside 80 when the disc 104 is moved to a position against the front 70 of the barrel 20.

As shown in FIG. 9, the detent 18 includes a "Y" shape and includes a first leg 120 and a second leg 122 connected at a junction 124. Preferably, the first and second legs 120, 122 are integrally formed, such that the detent 18 is a single piece, made from plastic that is partially bendable, but not significantly compressible. The first leg 120 has an engagement surface at its projected end that is opposite of the junction end 124. The junction end 124 is inserted into the detent slot 82 at the rear of the backside 80. The first leg 120 faces toward the front 70 of the barrel 20. The engagement surface of the first leg 120 engages with protrusion 130 extending from the back 72 of the barrel 20. The first leg 120 is preferably longer than the second leg 122 and may be slightly flexed or bent, such that it is resiliently fixed within the backside 80.

The free end 126 of the second leg 122 is located to engage the second plurality of teeth 112 on the rod 102. The engagement surface 128 on the free end 126 of the second leg 122 is shown in contact with one tooth 132 with the second plurality of teeth 112. The engagement of the detent 18 with the second set of teeth 112 holds the rod 102 in position against the force of the material in the tube 30 of the cartridge 12. As the plunger 28 moves forward due to the movement of the trigger 22 to the second position 26 (see FIG. 2), the resilience of the detent maintains the free end 126 of the second leg 122 in contact within the second plurality of teeth 112 on the rod 102. As the trigger 22 moves the plunger 28 forward, the second leg 122 bends or flexes to move over a second tooth 134. Once the free end 126 of the second leg 122 is clear of the second tooth 134, the free end 126 moves into position contacting the vertical leg 116 of the second tooth 134 and forms a stop to rearward movement, maintaining the incrementally forward position. The process is repeated for incremental forward movement of the plunger 28.

When the user desires to release pressure within the cartridge 12 or retract the plunger 28, the rod 102 is rotated, such that a smooth side (no teeth) 118 of the rod 102 is facing the detent 18. Without the engagement of the teeth on the rod 102, the plunger 28 may be retracted away from the cartridge 12. A similar disengagement of the first set of teeth 110 occurs between the tooth extension 90 of the trigger 22.

Figure 10:
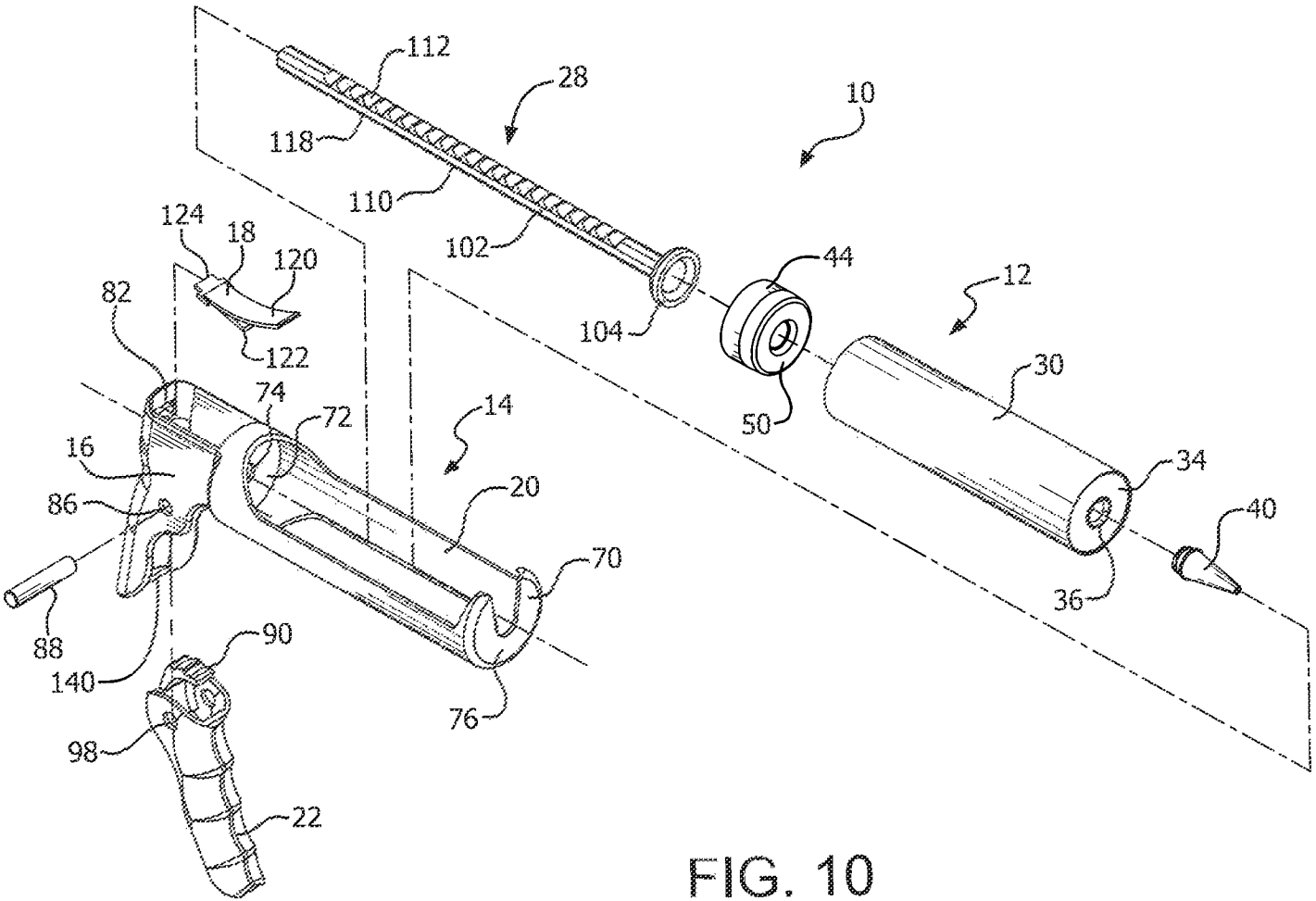
FIG. 10 is an exploded perspective view of the dispensing device of FIG. 1.

FIG. 10 shows an exploded view of all of the pieces that form the dispensing device 10. The cartridge 12 is formed by removing the nozzle 40 from the cup member 42 and inserting it into the nozzle opening 36. The actuator 14 is formed by inserting the rod 102 through the rear opening 74 and the rod opening 84. The disc 104 of the plunger 28 is then positioned in the barrel 20. The trigger 22 is attached to the handle 16 by inserting the pin 88 through the corresponding openings 86, 98 on the handle 16. The detent 18 is inserted into the slot 82 and the first leg 120 is snapped into place on the back 72 of the barrel 20. The dispensing device 10 is created by placing the cartridge 12 into the upper opening of the barrel 20 and locating the plunger 28 within the second opening 44 of the cartridge 12. The disc 104 of the plunger 28 is preferably in contact with the bottom 50 of the cup member 42. The nozzle 40 rests within the nozzle slot 76 in the front 70 of the barrel 20.

FIG. 9 shows the movement of the trigger 22 as it rotates about the pin 88 from the first position 24 to the second position 26. The second position 26 of the trigger 22 is substantially adjacent to the handle 16. The tooth extension 90 rotates about the pin 88, causing linear forward movement of the plunger 28 along the axis CB of the barrel 20 as a result of the interaction with the first plurality of teeth 110. As the plunger 28 moves forward, it is held in the more forward position by the resilient engagement of the detent 18. The trigger 22 may be moved back to the first position 24 either manually or by the including a spring element between the handle 16 and the trigger 22. Once the trigger 22 is again in the first position 24, movement to the second position 26 may be repeated to provide additional pressure within the cartridge 12 to expel the viscous material through the nozzle 40, or to maintain a constant flow of the material.

Figure 11:
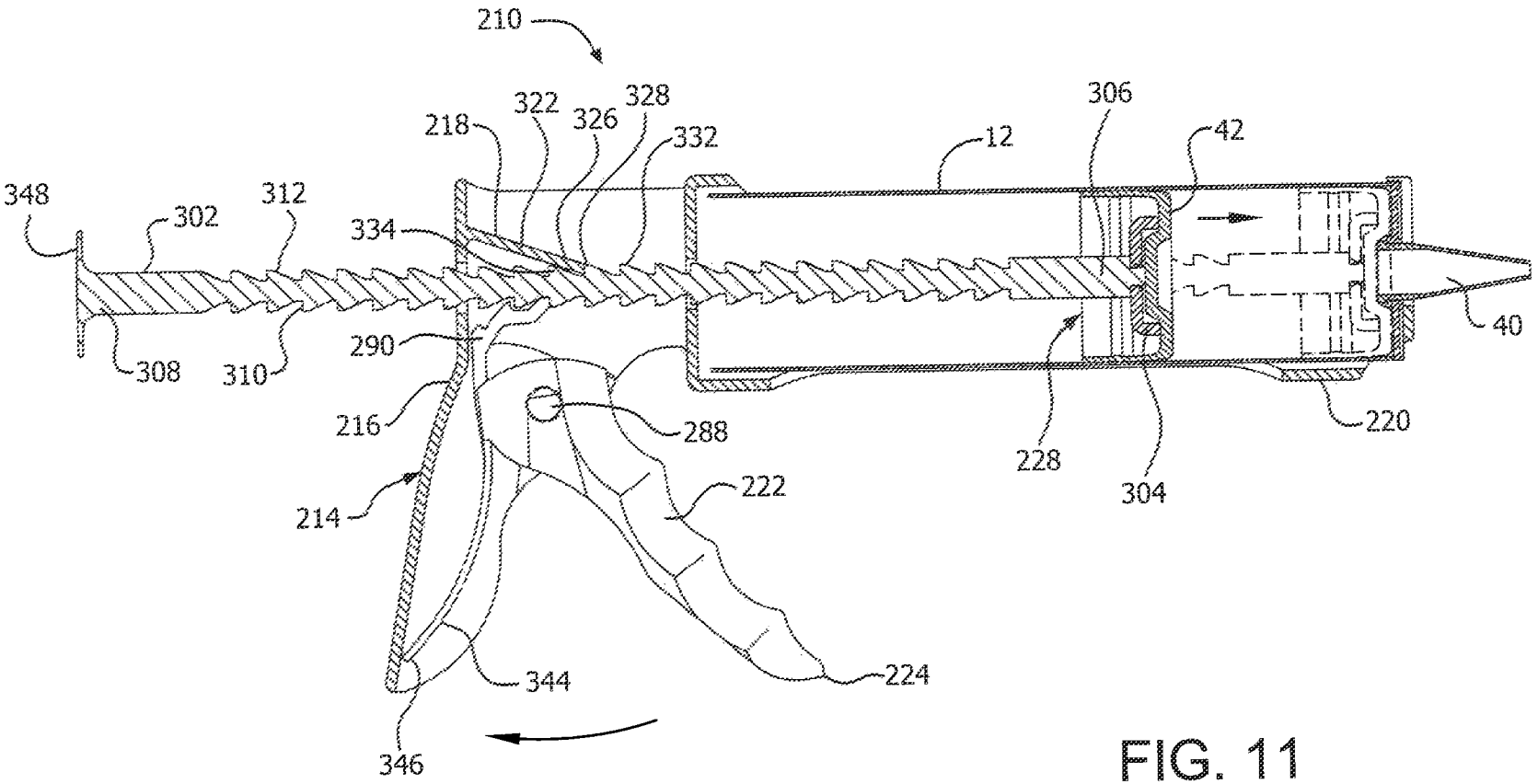
FIG. 11 is a cross section view of a further embodiment of a dispensing device as contemplated by the present disclosure.

Another form of a dispensing device 210 is shown in FIGS. 11-14. The device 210 includes a cartridge 12 generally in the form as previously described. The cartridge 12 is shown in FIG. 11 positioned within an actuator 214 having a barrel 220 and a handle 216. A trigger 222 is attached to the handle 216. A detent 218 is integrally formed within the handle 216. The detent 218 is formed from a single leg 322 connected to the inside of an upper portion of the handle 216. A free end 326 of the detent 218 forms an engagement surface 328 for engaging with a vertical surface 332 of a tooth of a second plurality of teeth 312 on a rod 302. The detent 218 angles downwardly toward the teeth 312 on the rod 302. The trigger 222 includes a tooth extension 290 that projects upwardly from a pivot 288 and engages a first plurality of teeth 310 on a bottom surface of the rod 302.

The trigger 222 is integrally formed with a spring 344. The spring 344 extends reward from the body of the trigger 222 and includes an end portion 346 that engages an inside surface of the handle 216. The spring 344 provides a resilient return force that causes the trigger 222 to move from the second position (such as position 26 in FIG. 9) to the first position 224 as shown in FIG. 11. The spring 344 and trigger 222 are preferably formed from a polymer material with elastic properties such that when the trigger 222 is released from second position, the spring 344 supplies a return force to the trigger 222.

The trigger pivot 228 is formed by an integrated pin structure that projects transversely from the trigger body. The pivot 288 connects the trigger 222 to the handle 216. The handle 216 includes two handle openings 286, one on each side. The pivot projections 288 are inserted within the U-shape of the handle 216. The trigger 222 and/or the handle 216 elastically deform to allow the pins 288 to pass into the handle and aligned with the handle openings 286. The pins 288 snap into the respective openings 286 and pivotably retain the trigger 222 on the handle 216.

The pivotal mounting of the trigger 222 on the handle 216 creates a driving mechanism for the rod 302. The rod 302 is positioned on the handle 216 in a fashion similar to the rod 102 in FIG. 9. The teeth 310 and 312 are engaged by the tooth extension 290 and the detent 218 in the normal rest position of the dispenser 210. Movement of the trigger 222 causes a rotation about the pins 288 and a forward movement of the tooth extension 290. The engagement of the tooth extension 290 on the first plurality of teeth 310 pushes the rod 302 forward. The detent 218 maintains the rod 302 engaged with the tooth extension 290. During the forward motion of the rod 302, the detent 218 indexes over individual teeth on the upper plurality of teeth 312. During the return of the trigger 222 to the first position, caused by the resilience of the spring 344, the detent 218 fixes the position of the rod 302, while the extension 290 indexes reward, over the teeth of the first plurality 310. The forward movement of the rod 302 creates a discharge force by the plunger 228, which is applied to the moveable cup member 42 within the tube 30 of the cartridge 12.

Figure 12:
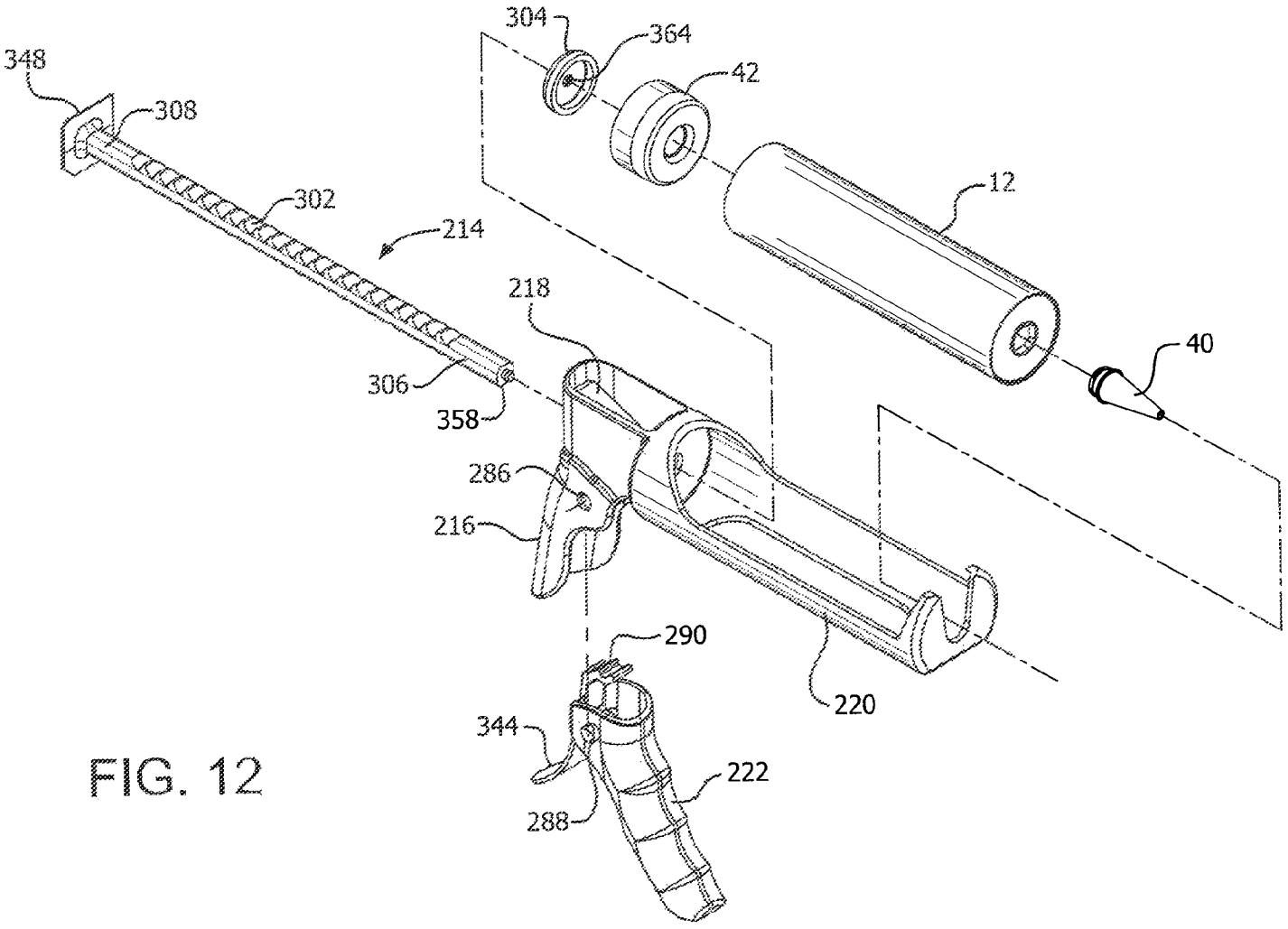
FIG. 12 is an exploded perspective view of the dispensing device of FIG. 11.
Figure 13A:
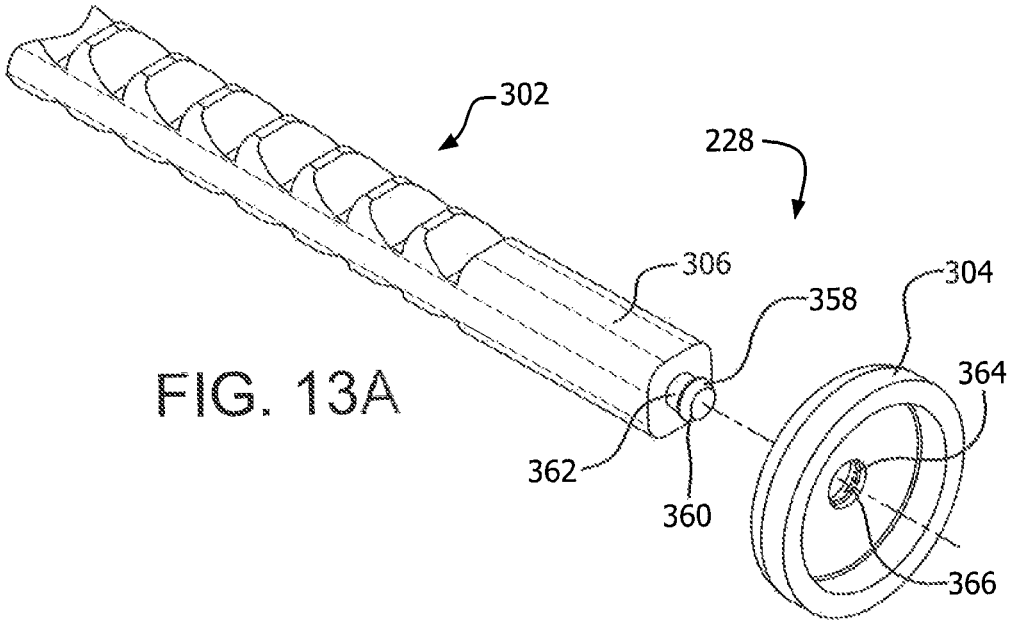
FIGS. 13A and 13B are perspective views of rod and disc portions of the dispensing device of FIG. 11.
Figure 13B:
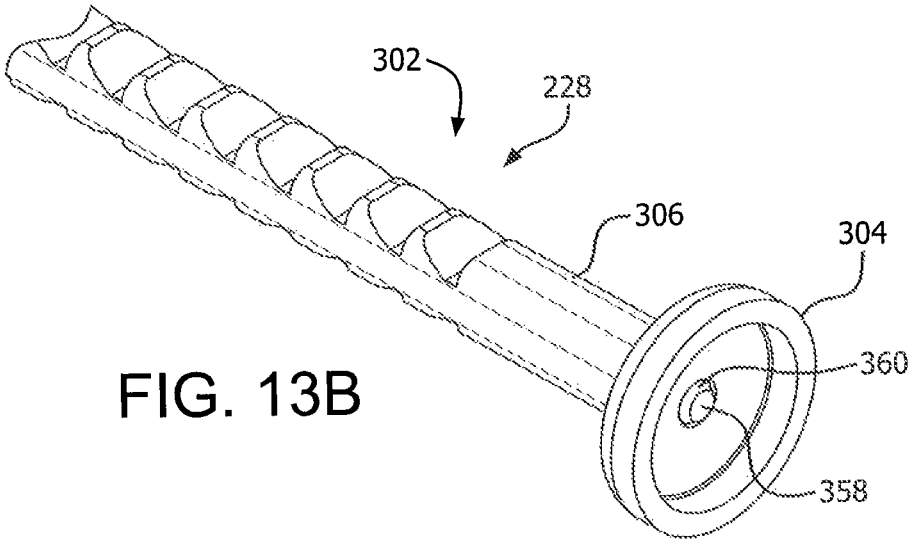
Figure 14:
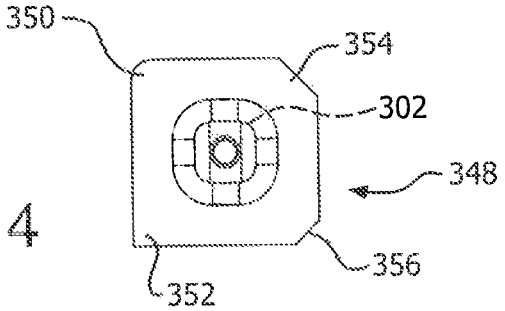
FIG. 14 is a side elevation view of a finishing device as formed on one end of the rod portion of the dispensing device of FIG. 11.

The plunger 228 is shown in more detail in FIGS. 12 and 14. The plunger 228 is generally formed by the rod 302, a disc 304 and a finishing tool 348. The disc 304 has a centrally located opening 364 that is formed to receive a connector 358 on the end 306 of the rod 302. The connector 358 is contemplated to be press fit into the disc opening 364 to create the end of the plunger 228 that engages the movable member 42. The engagement structure of the connector 358 is shown in more detail in FIGS. 13A and 13B. A series of tabs 366 are located around the inside edge of the opening 364 in the disc 304. The tabs 366 are contemplated to be elastically deformable and engage the male connector 358. The connector 358 is shown as having a circular or rounded end 360 having a relatively larger diameter than a projecting shaft 362 on the end 306 of the rod 302. The connector 358 is inserted into the opening 364, with the tabs 366 engaging the end 360. This assembly of the disc 304 on the rod 302 is made after insertion of the rod 302 through the handle 216 and into the barrel 220 portion of the dispenser 210.

The finishing tool 348 is formed on a second 308 end of the rod 302, opposite of the connector 358. As more particularly shown in FIG. 14, the finishing tool 348 includes a substantially square shape; although any shape, including triangular, rectangular, pentagonal, hexagonal, etc., may be useful, Each corner of the finishing tool 348 has a different finishing edge. The various edge forms are contemplated to be usable to scrape excess material from an application surface, creating a desired appearance. As shown, a first corner 350 is rounded. A second corner 352 is squared. A third corner 354 and forth corner 356 are angled at 45 degrees, with each having a different scraping length.

Although the dispenser form of FIGS. 11-14 includes that differ from many of the different structures elements of the dispenser shown in FIGS. 1-10, it should be understood that the various structures from the two forms may be used in a number of different combinations and may be used with other dispenser forms.

In the embodiments shown, an assembly is provided with a minimal number of parts, which may be formed from molded plastic that are readily disposable or recyclable. The sizing of the nozzle for placement in the rear cup member on the cartridge facilitates efficient shipment and storage of the cartridge prior to use. The resilient Y-shaped or integrally formed detent creates a fixing force during movement of the plunger. The dispensing device may further be formed to include a single-use cartridge to minimize the cost of manufacturing and to reduce the material that is disposed after use. The device, however, contemplates use with multiple cartridges, should there be a need for additional material during use.

The present disclosure shows and describes exemplary embodiments. It should be understood by those skilled in the art from the foregoing that various other changes, omissions and additions may be made therein, without departing from the spirit and scope of the contemplated invention, with the scope of the invention being defined by the foregoing claims. Further, the terms herein are used in a generic and descriptive sense and are not necessarily for purposes of limitation. The scope of the invention is set forth in the following claims.

What is claimed is:

1. A cartridge for holding viscous material comprising:

a tube with a first end having a end wall and a nozzle opening therein, a second end forming a second opening is provided at the opposite end of the tube from the end wall;

a removable seal covering the nozzle opening;

a cup member located within the second end of the tube and longitudinally movable within the tube, the moveable member having a bottom and one or more sidewalls for sealing with inside walls of the tube; and a nozzle formed for attachment to the nozzle opening in the end wall, the nozzle sized and dimensioned for securing within the sidewalls of the moveable member during shipment and storage, the tube, tube end wall and bottom of the cup member combining to define a chamber for storing the viscous material.

2. The cartridge as in claim 1 wherein the nozzle has an engagement end portion and a tip, the engagement end portion sized and formed for insertion into the nozzle opening.

3. The cartridge as in claim 1 wherein a length of the nozzle is substantially equivalent to a distance between the sidewalls of the cup member for creating a friction fit upon insertion of the nozzle within the cup member.

4. The cartridge as in claim 1 further comprising a second removable seal covering the second opening.

5. The cartridge as in claim 1 wherein the chamber has a volume of about 4ounces.

6. The cartridge as in claim 1 wherein the nozzle comprises an engagement end for fixing the nozzle to the nozzle opening.

7. The cartridge as in claim 6 wherein the engagement end of the nozzle frictionally fixes the nozzle in the nozzle opening.

* * * * *